US005872495A

United States Patent [19]

DiMarco et al.

[11] Patent Number: 5,872,495

[45] Date of Patent: Feb. 16, 1999

[54] VARIABLE THERMAL AND MAGNETIC STRUCTURE FOR A CIRCUITBREAKER TRIP UNIT

[75] Inventors: Bernard DiMarco, Lilburn; James E. Ferree, Lawrenceville; Robert E. Black, Snellville, all of Ga.

[73] Assignee: Siemens Energy & Automation, Inc., Alpharetta, Ga.

[21] Appl. No.: 988,060

[22] Filed: Dec. 10, 1997

[51] Int. Cl.[6] ..... H01H 75/12

[52] U.S. Cl. ..... 335/35; 335/22; 337/75

[58] Field of Search ..... 335/23–5, 167–76, 335/35–45, 22; 337/75–77, 100–101, 102, 103, 104, 112

[56] References Cited

U.S. PATENT DOCUMENTS

| | | | |
|---|---|---|---|
| 1,971,205 | 8/1934 | Walle . | |
| 2,140,362 | 12/1938 | Kintzing . | |
| 2,821,595 | 1/1958 | Deans . | |
| 3,200,217 | 8/1965 | Bullis, Jr. . | |
| 3,217,125 | 11/1965 | Brackett . | |
| 3,720,891 | 3/1973 | Nicol . | |
| 3,836,691 | 9/1974 | Wolfe . | |
| 3,864,649 | 2/1975 | Doyle . | |
| 4,047,134 | 9/1977 | Maier et al. . | |
| 4,066,990 | 1/1978 | Cstuor . | |
| 4,187,482 | 2/1980 | Kosup . | |
| 4,220,935 | 9/1980 | Wafer et al. . | |
| 4,468,645 | 8/1984 | Gerbert-Gaillard et al. . | |
| 4,503,408 | 3/1985 | Mrenna et al. . | |
| 4,516,098 | 5/1985 | Krasser et al. | 335/35 |
| 4,528,531 | 7/1985 | Flick et al. . | |
| 4,603,312 | 7/1986 | Conner . | |
| 4,630,019 | 12/1986 | Maier et al. . | |
| 4,675,635 | 6/1987 | DiMarco et al. . | |
| 4,691,182 | 9/1987 | Mrenna et al. . | |
| 4,706,054 | 11/1987 | Hampton et al. . | |
| 4,733,033 | 3/1988 | Morris et al. . | |
| 4,890,081 | 12/1989 | McKee et al. . | |
| 4,922,220 | 5/1990 | Livesey et al. . | |
| 4,958,136 | 9/1990 | Maier et al. . | |
| 4,973,928 | 11/1990 | Grunert . | |
| 5,231,365 | 7/1993 | Kato . | |
| 5,237,297 | 8/1993 | Ellington et al. . | |
| 5,381,120 | 1/1995 | Arnold et al. . | |
| 5,432,491 | 7/1995 | Peter et al. . | |
| 5,539,167 | 7/1996 | Hood et al. . | |
| 5,608,367 | 3/1997 | Zoller et al. . | |

*Primary Examiner*—Lincoln Donovan

[57] ABSTRACT

A thermal and magnetic trip unit for a multi-pole circuit breaker includes a thermal structure having a bimetallic element and one or more heater elements. Each of the heater elements and a portion of the bimetallic element is generally "U" shaped defining a conductive path which extends from one leg of the U to the other leg. The heater elements and bimetallic element may be configured in parallel to reduce the level of current flowing through the bimetallic element and thus increase the current level at which the bimetallic element will trip the breaker. Alternatively, the heater elements may be configured in series with the bimetallic element, by inserting electrical insulators between the bimetallic element and each of the heater elements and connecting the various "U" shaped elements using a connecting bus which connects the second leg of one element to the first leg of the next element. In this configuration, the thermal structure defines a coil having one turns for each heater element and the bimetallic element. This coil may be used to implement a magnetic trip structure by inserting one or two magnetically permeable yokes, each yoke surrounding one leg of the combined thermal structure. An armature is positioned to be separated from the yoke by a gap such that, when the armature is pulled toward the yoke, it will engage the trip unit. In addition, the trip unit includes a calibration and adjustment bar that allows the gap to be adjusted as well as the force exerted on the armature by a biasing spring. The calibration and adjustment bar also allows each pole of the circuit breaker to be independently calibrated.

13 Claims, 11 Drawing Sheets

VARIABLE THERMAL AND MAGNETIC STRUCTURE FOR A CIRCUITBREAKER TRIP UNIT

FIELD OF THE INVENTION

The present invention relates generally to a circuit breaker and more particularly to a configurable thermal and magnetic structure for tripping the circuit breaker.

BACKGROUND OF THE INVENTION

It is common for circuit breakers to employ thermal and magnetic elements which trip the circuit breaker under various overcurrent conditions. The thermal component typically includes a bimetallic element which responds to relatively long duration overload conditions to trip the breaker when a specified current level is exceeded for a period of time. In a typical thermal trip unit, at least a portion of the current flowing through the breaker is channeled through the bimetallic element. The ohmic resistance of the bimetallic element causes it to generate heat in proportion to the square of the level of current flowing through the breaker. As the bimetallic element becomes warmer, it bends and, when it reaches a predetermined temperature, engages a trip mechanism. The trip mechanism releases a latch which holds the breaker contacts closed. When this latch is released, the breaker contacts open, typically responsive to a relatively strong force.

A typical magnetic tripping element includes an armature which is attracted by a magnetic field generated by a relatively high magnitude overcurrent flowing through the breaker. This magnetic field is concentrated by a magnetically permeable yoke which surrounds the conductor through which the current flows. When the armature is attracted to the yoke, it also engages the trip mechanism causing the circuit breaker to open. Both thermal and magnetic structures are used in a typical circuit breaker trip unit to enable the breaker to be tripped on a relatively low overload condition having a long duration and to trip quickly in response to a relatively high overcurrent condition.

It is desirable to be able to configure and adjust the current levels and current durations which cause a breaker to trip in order to customize the circuit breaker to a particular application. Typically, thermal and magnetic structures in circuit breaker trip units may be adjusted to accommodate a relatively narrow variation in current magnitude and current flow duration. These adjustments are made by changing the distance between the bimetallic element and the trip bar for a thermal element and by adjusting the separation between the armature and the yoke for a magnetic trip element.

SUMMARY OF THE INVENTION

The present invention is embodied in a thermal and magnetic trip structure which may be configured to accommodate a wide range of overcurrent conditions. The exemplary structure includes a thermal trip unit having a bimetallic element and one or more resistive heating elements. The heating elements may be configured in series or in parallel with the bimetallic element to respectively increase or decrease the heating effect resulting from a given current level. In addition, the series connected resistive heating elements may be configured to form an inductance which enhances the magnetic field that attracts the armature to trip the breaker on short duration overcurrent conditions.

According to one aspect of the invention, the electromagnetic structure includes one or two magnetically permeable yokes which interact with the heating elements and the bimetallic element to produce an enhanced magnetic field for the operation of the magnetic trip unit.

According to another aspect of the invention, the magnetic portion of the trip unit includes two calibration adjustments for each pole of the breaker, the first calibration adjustment adjusts the gap between the armature and the yoke and the second adjustment adjusts the tension of a spring connected to the armature. This spring provides a force which must be overcome in order to magnetically trip the breaker.

According to another aspect of the invention, the trip unit includes an adjustment bar which may be used to vary the spacing between the armature and the yoke in all poles of the breaker to allow the trip range of the trip unit to be changed in the field.

According to yet another aspect of the invention, the adjustment bar may be used to change the angle of the tension springs for all poles of the breaker to allow the trip range of the circuit breaker to be changed in the field.

DETAILED DESCRIPTION

Figure 1:
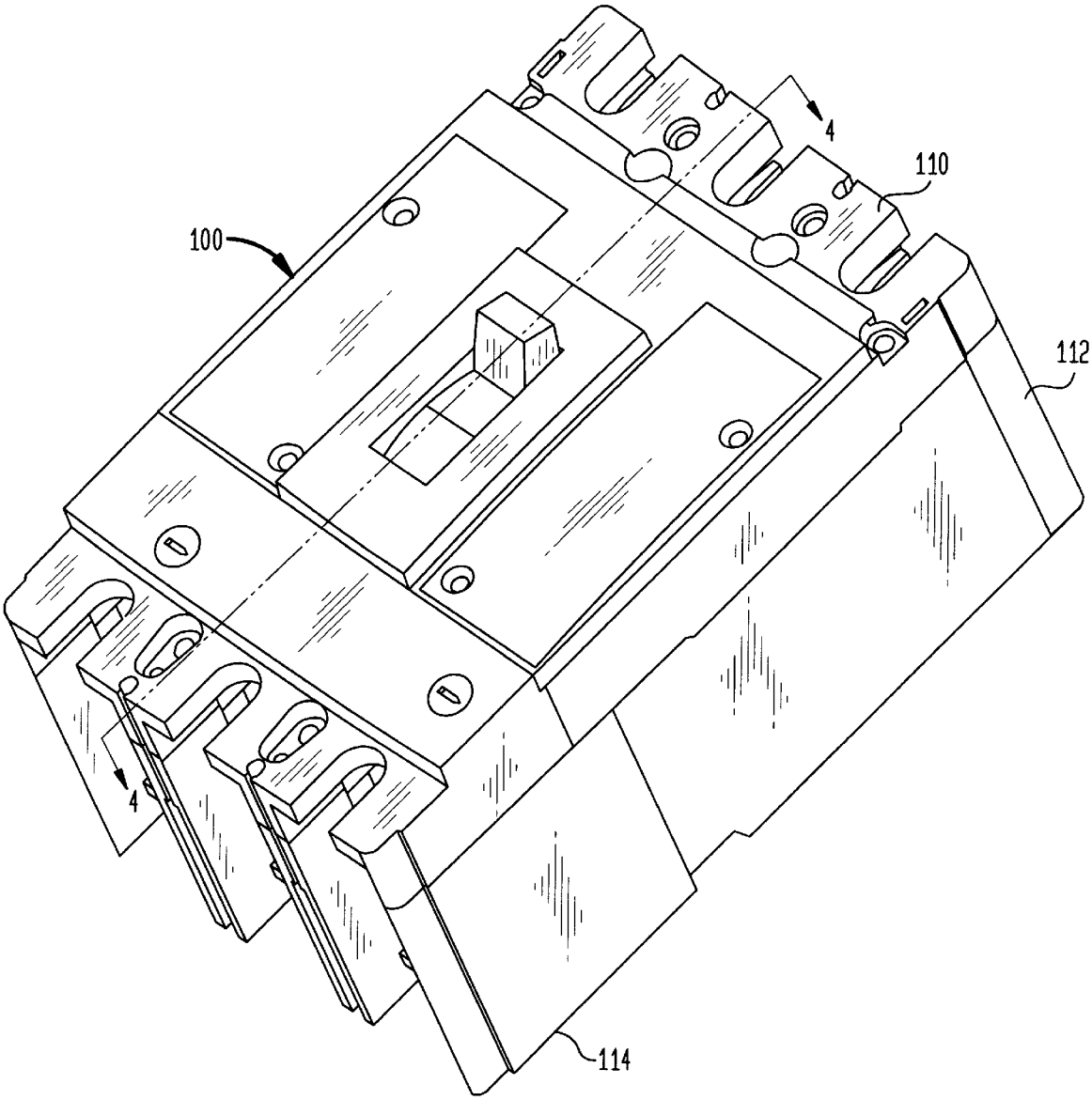
FIG. 1 is an isometric drawing of a circuit breaker which includes an embodiment of the resent invention.

FIG. 1 is an isometric drawing of a circuit breaker which includes an embodiment of the present invention. The circuit breaker shown in FIG. 1 is a multi-part molded case circuit breaker. The breaker 100 includes a cover 110, a trip unit 114 and a switch unit 112. The exemplary circuit breaker 100 is a three-phase breaker having three sets of contacts for interrupting current in each of the three respective phases. In the exemplary embodiment of the invention, each phase includes separate breaker contacts and a separate trip mechanism. The center pole of the circuit breaker includes an operating mechanism which controls the switching of all three poles of the breaker. Although the present invention is described in the context of a three-phase circuit breaker, it may be practiced in a single phase breaker or other multiphase breakers.

Figure 4:
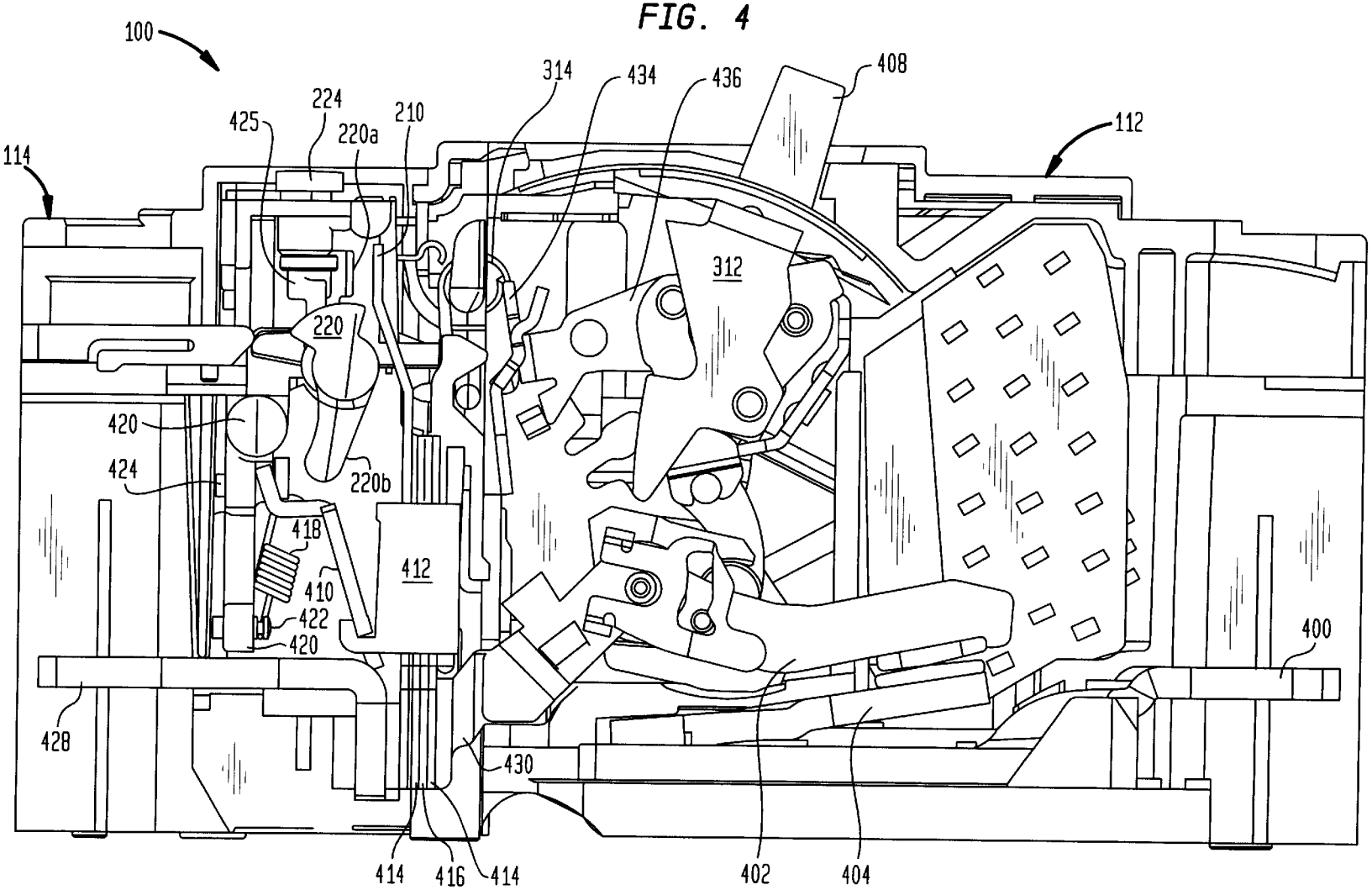
FIG. 4 is a cutaway side plan drawing of the circuit breaker shown in FIG. 1, along lines 4—4, which is useful for describing the operation of the trip unit shown in FIG. 2.

FIG. 4 is a cutaway view of the complete circuit breaker along the lines 4—4 shown in FIG. 1. As shown in FIG. 4, the main components of the circuit breaker are a fixed line contact arm 404 and a moveable load contact arm 402. The operating mechanism 312 may be controlled by a toggle handle 408 to manually open and close the contact arms 402 and 404. When the contact arms are closed, a cradle 436 of the operating mechanism 406 engages a latch 434. In the exemplary embodiment of the invention, the cradle 463 pushes up against a latch surface of the latch 434 with a force of approximately 40 pounds. As described below, when an overcurrent condition occurs in the trip unit 114 the latch 434 is released, releasing the cradle 436 and opening the contact arms 402 and 404.

Figure 2:
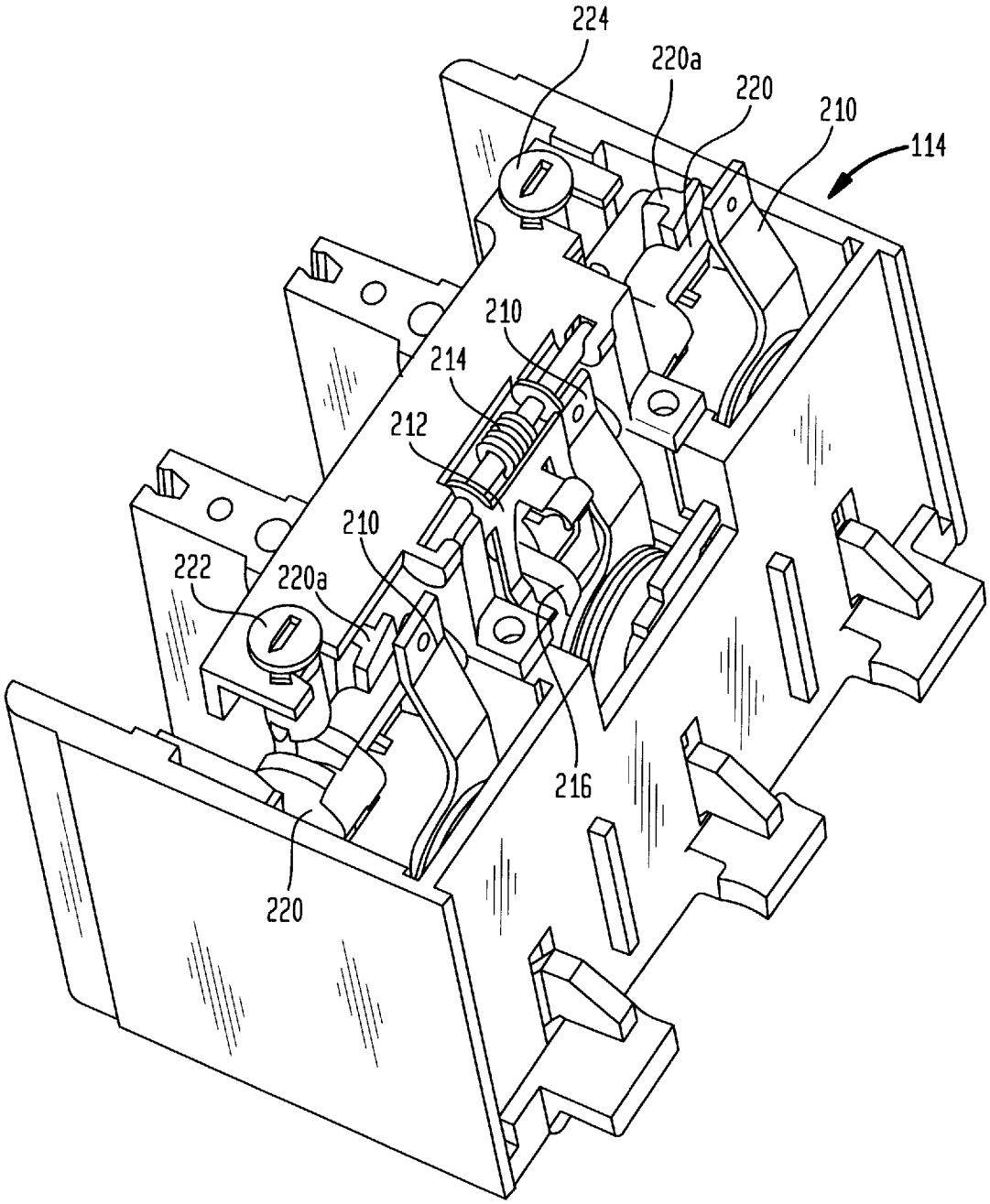
FIG. 2 is an isometric drawing of a magnetic and thermal trip unit, according to the present invention, for the circuit breaker shown in FIG. 1.

FIG. 2 is an isometric drawing of the trip unit 114 with the cover 110 removed. As shown in FIG. 2, each of the breaker poles includes a separate bimetallic element 210. When the bimetallic element 210 in any of the breaker poles is heated by, for example, a relatively long duration but low magnitude overcurrent, the bimetallic element deflects to engage a surface 220A on a trip bar 220. As the bimetallic element 210 deflects further, its pressure on the surface 220A causes the trip bar 220 to rotate in a counterclockwise direction. This rotation releases a latch 216 which holds a latch kicker 212 in place. As the latch 216 is rotated in a counterclockwise direction, the latch kicker 212, is released and is allowed to rotate in a counterclockwise direction responsive to the force exerted on it by a torsion spring 214. As described below, it is the motion of the latch kicker 212 which trips the breaker, ultimately causing the contacts 402 and 404 (shown in FIG. 4) to open.

Figure 3:
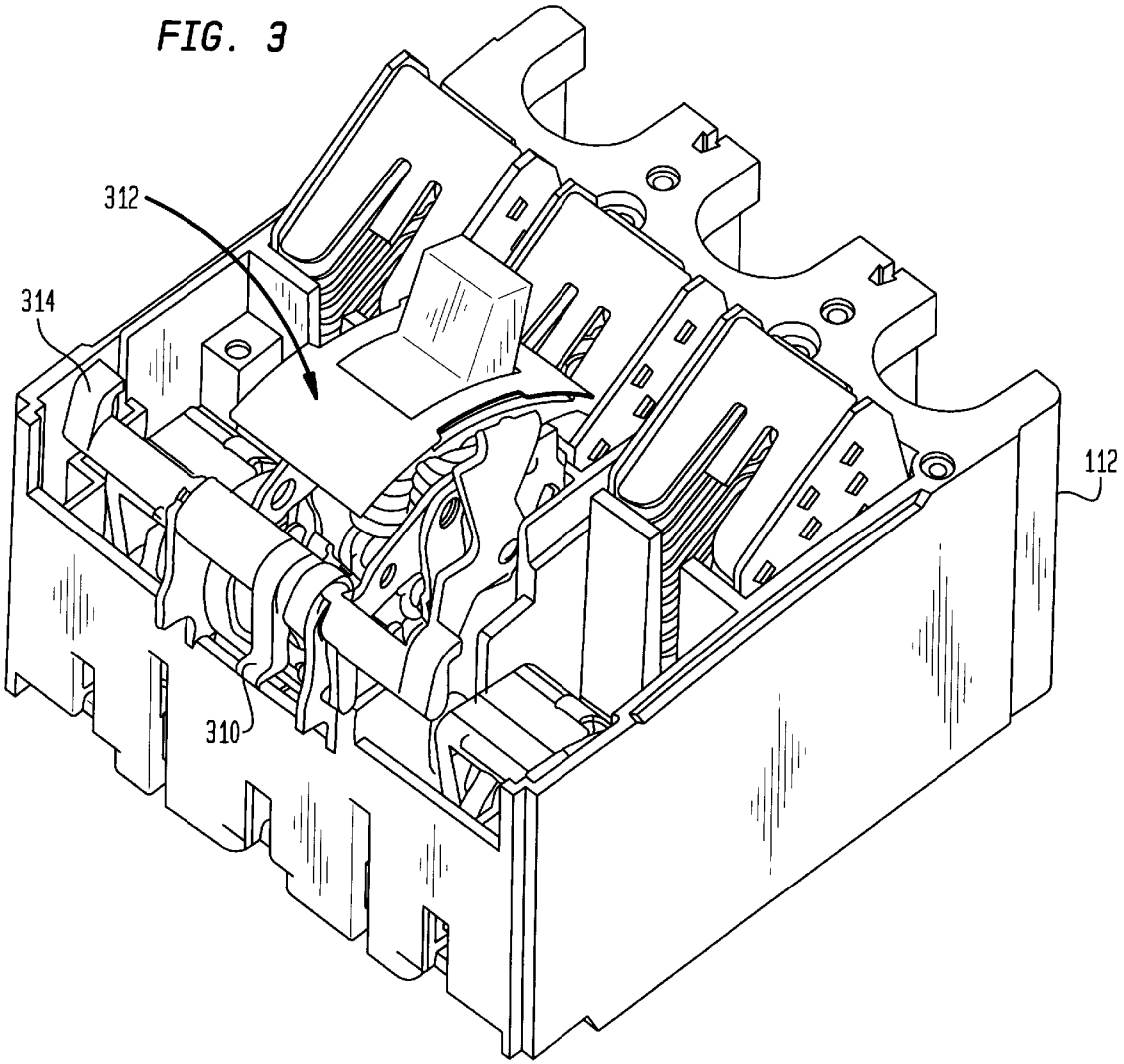
FIG. 3 is an isometric drawing of a circuit breaker switch unit suitable for use with the trip unit shown in FIG. 2.

FIG. 3 is an isometric drawing of the switch unit 112 of the circuit breaker 100 with the cover 110 removed. The circuit breaker shown in FIG. 3 includes an intermediate latch bar 314 having a trip foot 310 which is engaged by the latch kicker 212 when the breaker trips. As the latch kicker 212 is released and rotates in a counterclockwise direction, it hits the trip foot 310 of the intermediate trip bar 314, causing it to rotate in a counterclockwise direction. As described below with reference to FIG. 4, the rotation of the secondary trip bar 314 releases a latch which allows the operating mechanism of the breaker to open the load and line contacts in each of the three breaker poles.

As shown in FIG. 4, current is applied to the breaker 100 at a line terminal 400. The current flows through the line terminal to a line contact arm 404 and then through a load contact arm 402. The load contact arm 402 is connected to a copper bus 430 which couples the current to the trip unit 114. In the trip unit 114, the current flows through heating elements 414 which, in the exemplary configuration, are separated by an insulating element 416. The heating elements 414 are mechanically coupled to a bimetallic element 210 which, during an overcurrent condition, deflects to engage the surface 220A of the trip bar 220. The bimetallic element 210 is coupled to a load terminal 428 to provide current from the circuit breaker 100 to a load device.

In addition to the thermal trip mechanism, the exemplary trip unit includes a magnetic trip mechanism. This trip mechanism includes a yoke 412, which surrounds the heating elements 416 and bimetallic element 210, and an armature 410 that, during a large overcurrent condition, is attracted by magnetic forces generated by the current flowing through the heating units and bimetallic element and concentrated by the yoke 412. The armature 410 is coupled to a rating and calibration bar 420 by a spring 418. When the magnetic force developed by the heating elements, bimetallic element and yoke 412 is sufficient to overcome the force of the spring 418, the armature 410 is drawn toward the yoke 412 and engages the lower arm 220B of the trip bar 220. This rotates the tripbar 220 in a counterclockwise direction causing it to disengage latch 216 from latch kicker 212 (both shown in FIG. 2).

As described above, when latch kicker 212 is released, it engages secondary latch bar 314 causing it to release latch 434. Latch 434, when in the engaged position, holds cradle element 436 of the operating mechanism 312. When the latch is engaged, the cradle element 436 pushes up against the latch surface of the latch 434 with a force of approximately 40 pounds. As latch 434 is released, cradle element 436 rotates in a clockwise direction causing the operating mechanism 312 to open the connection between the load contact arm 402 and the line contact arm 404.

The rating of the breaker (i.e. the current at which the breaker will trip) may be adjusted by turning an adjustment screw 222. When screw 222 is turned, a cam 425 rotates, causing the trip bar 220 to rotate relative to the latch 216. This rotation moves the contact surface 220A closer to the bimetallic element 210, allowing a lower level thermal deflection of the bimetallic element 210 to trip the breaker. As described below, the performance of the magnetic portion for all poles of the trip unit may also be adjusted using an adjustment knob 224 (shown in FIG. 2) which rotates the rating and calibration bar 420. The rating and calibration bar 420 includes a biasing spring (not shown) which biases the bar for rotation in a counterclockwise direction. In addition, as described below, the magnetic trip performance of each pole may be individually calibrated using adjustment screws 422 and 424.

Figure 5:
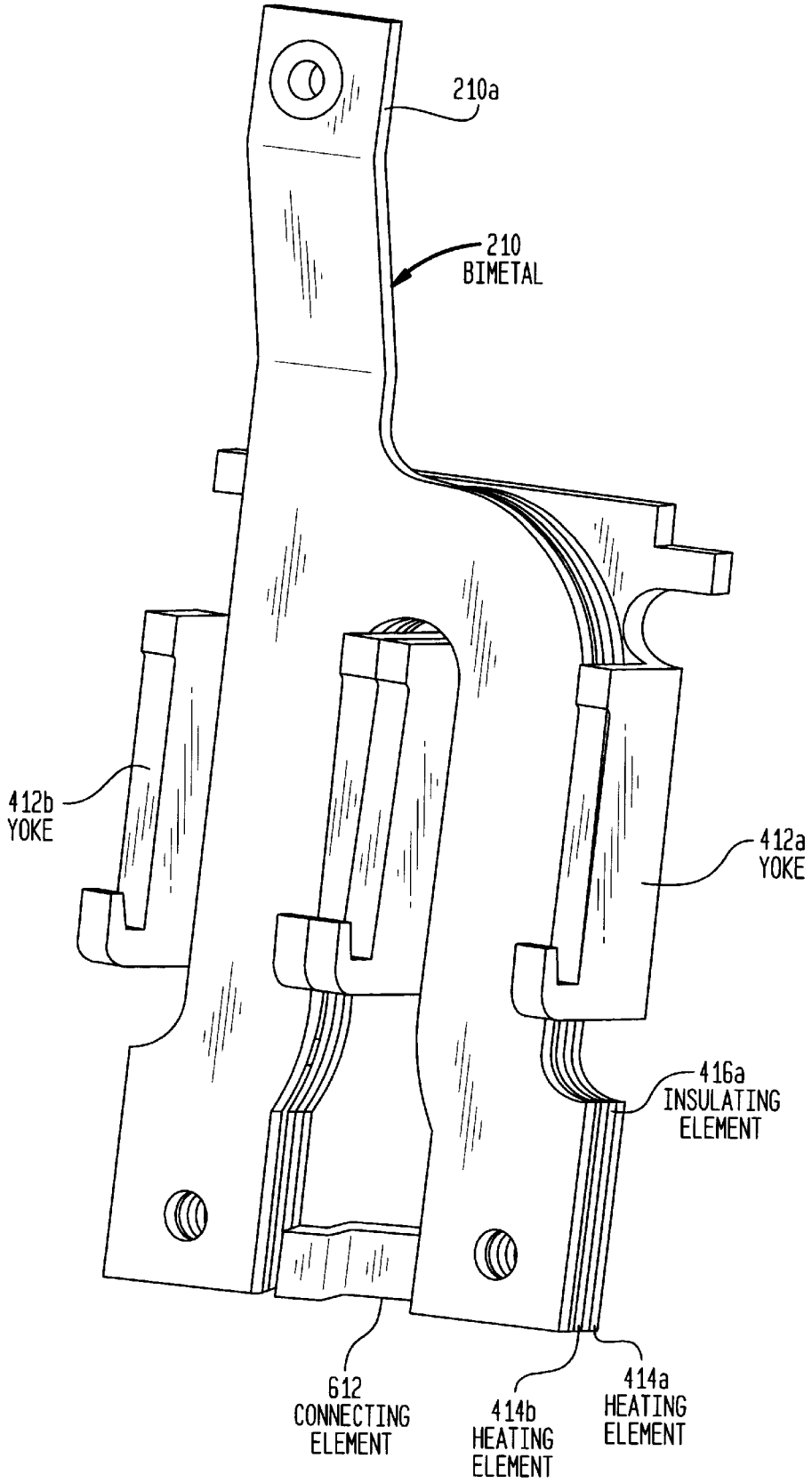
FIG. 5 is an isometric drawing of a configurable thermal unit suitable for use in the trip unit shown in FIG. 2.

FIG. 5 is an isometric drawing of a portion of an exemplary thermal and magnetic trip unit, suitable for use with the present invention. The thermal trip mechanism includes two heating elements 414*a* and 414*b*, an insulating element 416*a*, a bus structure 612*a* and the bimetallic element 210. Each of the heating elements 414*a* and 414*b* and the insulating element 416*a* are in an inverted "U" shape such that current flows through each of the elements from one leg of the "U" to the other leg. The bimetallic element includes a lower portion which is in an inverted "U" shape. Current being provided by the breaker flows through this lower portion of the bimetallic element. The bimetallic element also includes a protruding member 210*a* which extends from the top portion of the inverted "U" shape. The exemplary bimetallic element 210 may be made from any of a number of pairs of materials exhibiting different thermal expansion characteristics.

As is known in the art, the choice of the materials affects the amount by which the member 210*a* is deflected when the bimetallic element is heated as well as the current level required to produce a particular temperature. Relatively expensive materials may be needed to produce a bimetallic strip which exhibits a particular level of deflection at a specified current level. As described below, however, because the subject invention allows flexibility in the configuration of the thermal and magnetic tripping mechanisms precisely controlled levels of thermal and magnetic tripping currents may be handled using relatively inexpensive materials.

As shown in FIG. 5, one exemplary yoke structure 412 which may be used by a circuit breaker conforming to the subject invention, includes two yoke elements 412*a* and 412*b*, each wrapped around a respective leg of the inverted "U" shaped combination of the heating elements 414*a* and 414*b* and bimetallic element 210. As described below, this configuration of the yoke 412 causes a relatively high magnetic force to be generated at relatively low current levels.

Figure 6:
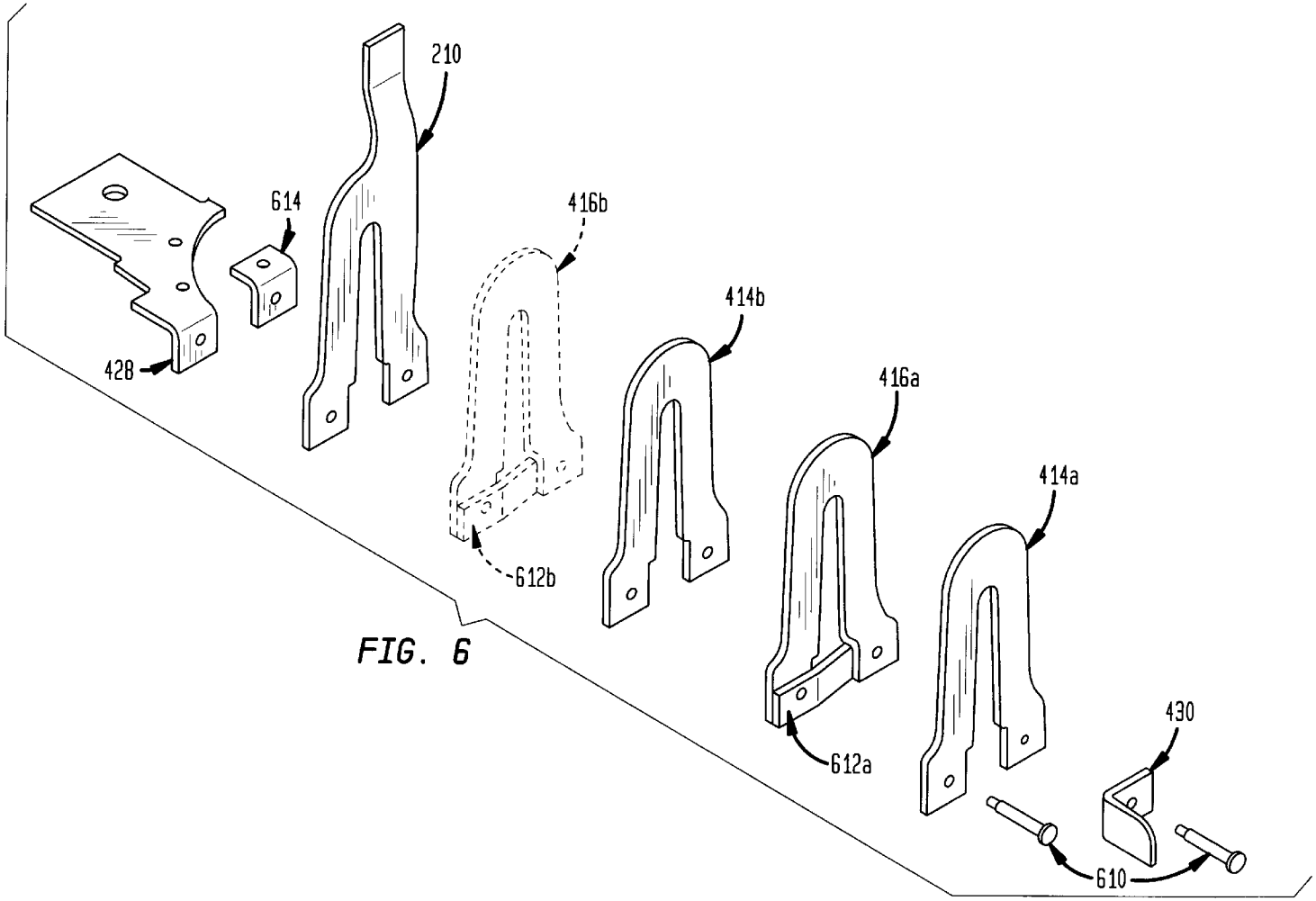
FIG. 6 is an exploded isometric drawing which illustrates the construction of the configurable thermal unit shown in FIG. 5.

FIG. 6 is an exploded isometric diagram showing the construction of an exemplary thermal unit of the thermal and magnetic trip unit shown in FIG. 2. In the exemplary thermal unit, the bus 430 is physically connected to a first heating element 414*a,* a first insulating element 416*a,* a second heating element 414*b,* a second insulating element 416*b* (showing in phantom) and the bimetallic element 210 via insulating rivets 610. Current is conveyed from the first heating element 414*a* to the second heating element 414*b* via a bus 612*a* which crosses from one side of the insulator 416*a* to the other side. The rivets 610 also connect the thermal structure to the load terminal 428 and to a structural coupling 614, which is not electrically connected to the circuit breaker mechanism.

In the configuration shown in FIG. 6, current flowing through the bus 430 flows through almost three complete loops through the heating elements 414*a,* bus structure 612*a,* heating element 414*b,* bus structure 612*b,* (shown in phantom) and bimetallic element 210. This series connection of the heating elements enhances the heating effect of any current flowing through the system. In this configuration, heat is generated not only by current flowing through the bimetallic element 210 but by current flowing through each of the heating elements 414*a* and 414*b*. Although insulating elements 416*a* and 416*b* provide some thermal insulation in addition to the electrical insulation, the net effect of the series combination of the heating elements 414*a,* 414*b* and the bimetallic element 210 causes a relatively large amount of heat to be generated for a relatively small current flow. This increased heating allows a less expensive bimetallic element to be used than may otherwise be needed to trip the breaker for a specified overcurrent level and duration.

This structure may be configured in several ways to produce different heating (and tripping) effects. For example, one of the heating elements 414*a* and 414*b* and one of the insulating elements 416*a* and 416*b* may be deleted. In this configuration, assuming the same materials as in the first configuration, a larger current flow may be needed to produce the same amount of heat and thus the same deflection of the bimetallic element 210. In another modification, the insulating elements 416 and busses 612 may be removed. In this configuration, the heating elements 414*a* and 414*b* are electrically configured in parallel with the bimetallic element 210. The current flow through each of the heating elements 414*a* and 414*b* and the bimetallic element 210 is in proportion to their respective conductivities. This configuration would further increase the amount of current needed to produce a given deflection of the bimetallic element as the heating elements 414*a* and 414*b* would act to shunt current that would otherwise flow through the bimetallic element 210 and, because the current flowing through each of the heating elements 414 would be less than the current flow through the elements shown in FIG. 6, the combination of the heating elements 414*a* and 414*b* bimetallic element 210 would not generate the same level of heat as the structure shown in FIG. 6 for the same current flow.

In another alternative configuration, one of the insulating elements, for example 416*a* and the corresponding bus element 612*a* may remain while the other insulating element, 416*b* and bus element 612*b* (both shown in phantom in FIG. 6) are removed. In this configuration, one heating element 414*a* is connected in series with a parallel combination of the other heating element 414*b* and the bimetallic element 210. This configuration would provide the additional heating effect of the first heating element 414*a* while protecting the bimetallic element 210 from overheating through use of the second heating element 414*b* as a current shunt. As set forth above, the choice of materials for the heating elements 414 and the bimetallic element 210 influences the operating characteristics of the thermal unit. In the exemplary embodiment of the invention, the heating elements 414*a* and 414*b* are copper and the bimetallic element is a combination of copper and steel. The exemplary insulators 416*a* and 416*b* are a flexible glass-melamine composition.

The structure of the thermal unit shown in FIG. 6, also influences the operation of the magnetic unit. The current flowing through the almost three turns of a coil formed by the first and second heating elements 414*a* and 414*b* and the bimetallic element 210 as coupled by the bus elements 612*a* and 612*b,* forms a coil that enhances the magnetic field generated from the current flowing through the structure.

Figure 7:
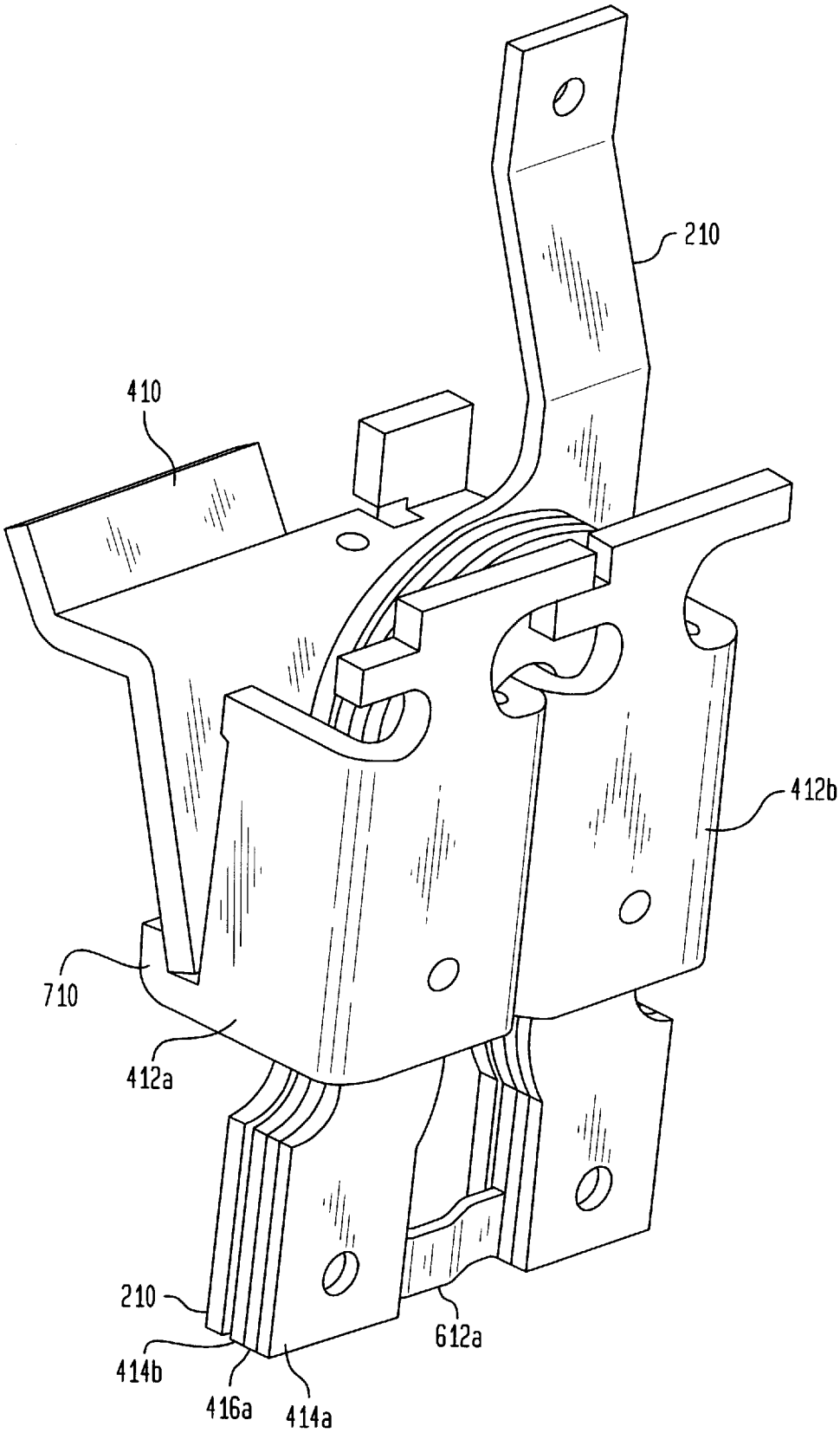
FIGS. 7 and 8 are isometric drawings which illustrate a thermal and magnetic structure suitable for use with the circuit breaker trip unit shown in FIG. 2.
Figure 8:
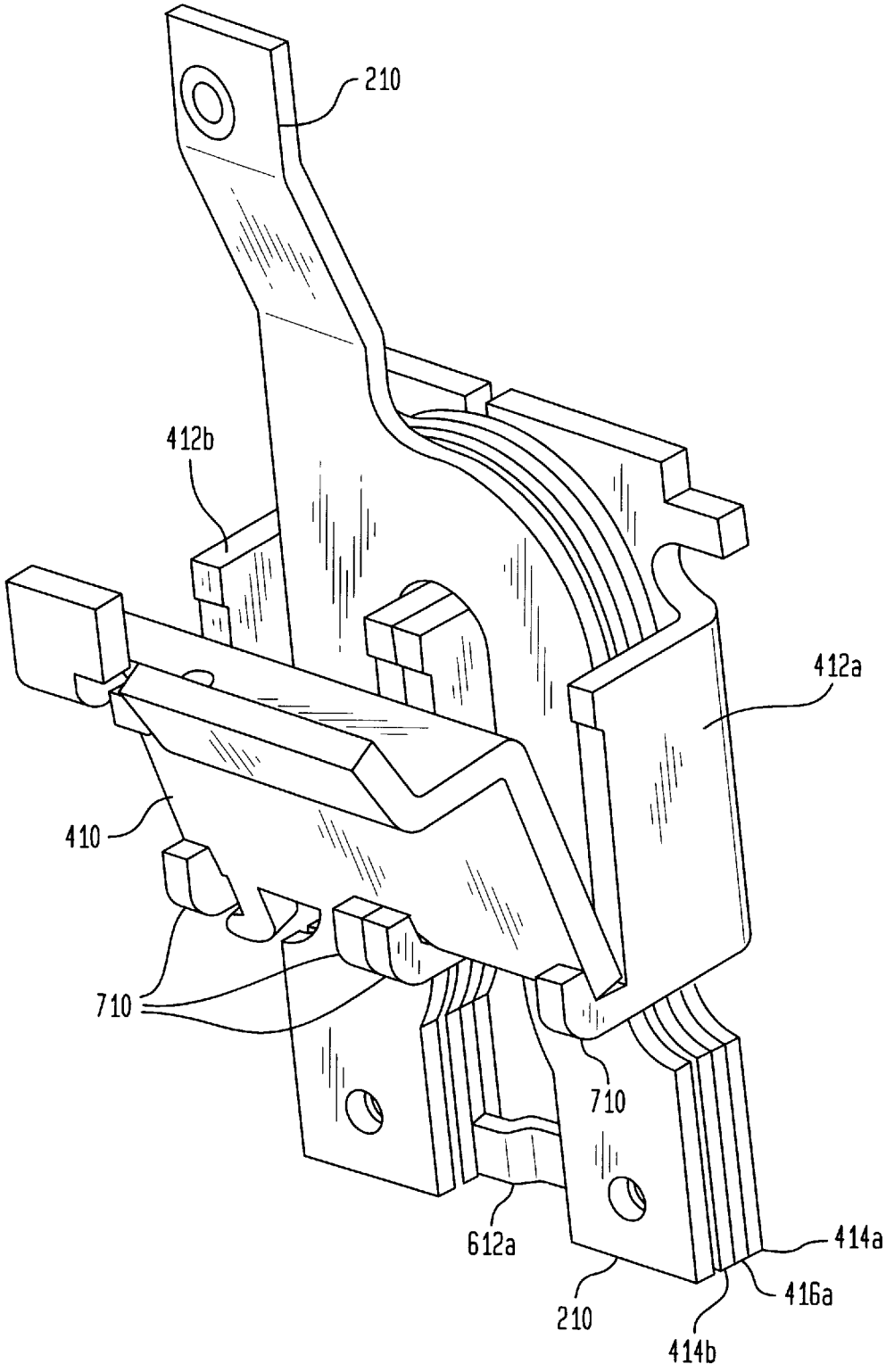

FIGS. 7 and 8 are isometric drawings which show rear and front views of the combined thermal structure, yoke 412 and armature 410. In the configuration shown in the FIGS. 7 and 8, two heating elements 414*a* and 414*b* are separated by the insulator 416*a*. In this configuration, the second heating element 414*b* is coupled in parallel with the bimetallic element 210.

The thermal and magnetic structure shown in FIGS. 7 and 8 includes two yoke elements 412*a* and 412*b*. Each of these yoke elements surrounds a respectively different arm of the inverted "U" thermal structure. In this configuration, the yokes 412*a* and 412*b* concentrate the magnetic field generated from the coil formed by the series connected heating element 414*a,* the bus element 612*a,* the parallel connected heating element 414*b* and the bimetallic element 210. The armature 410 rests in a holder 710 formed on the front of the yokes 412*a* and 412*b*. The gap between the armature 410 and the yoke structure 412*a* and 412*b* defines a level of magnetic force needed to trip the breaker. As described above, this level of magnetic force is generated by current flowing through the heating elements 414*a* and 414*b* bimetallic element 210.

The magnetic structure shown in FIGS. 7 and 8 is also adjustable to achieve a number of different characteristics for the breaker. As described above, the number of turns provided by the thermal structure may be adjusted by inserting or removing insulating elements 416 and bus elements 612. The magnetic field generated by the thermal structure increases with the increase in the number of turns. The performance of the magnetic structure may also be changed by removing one of the yokes, for example 412*a,* and providing a smaller armature 410, as shown, for example in FIG. 9. The use of one yoke, for example 412*b,* results in an approximate halving of the magnetic field generated by thermal and magnetic structure.

As described below, the operation of the magnetic structure may be affected by changing the gap between the armature 410 and yoke 412 as well as by changing the angle at which the spring 418 (shown in FIG. 4) acts against the armature 410.

Figure 9:
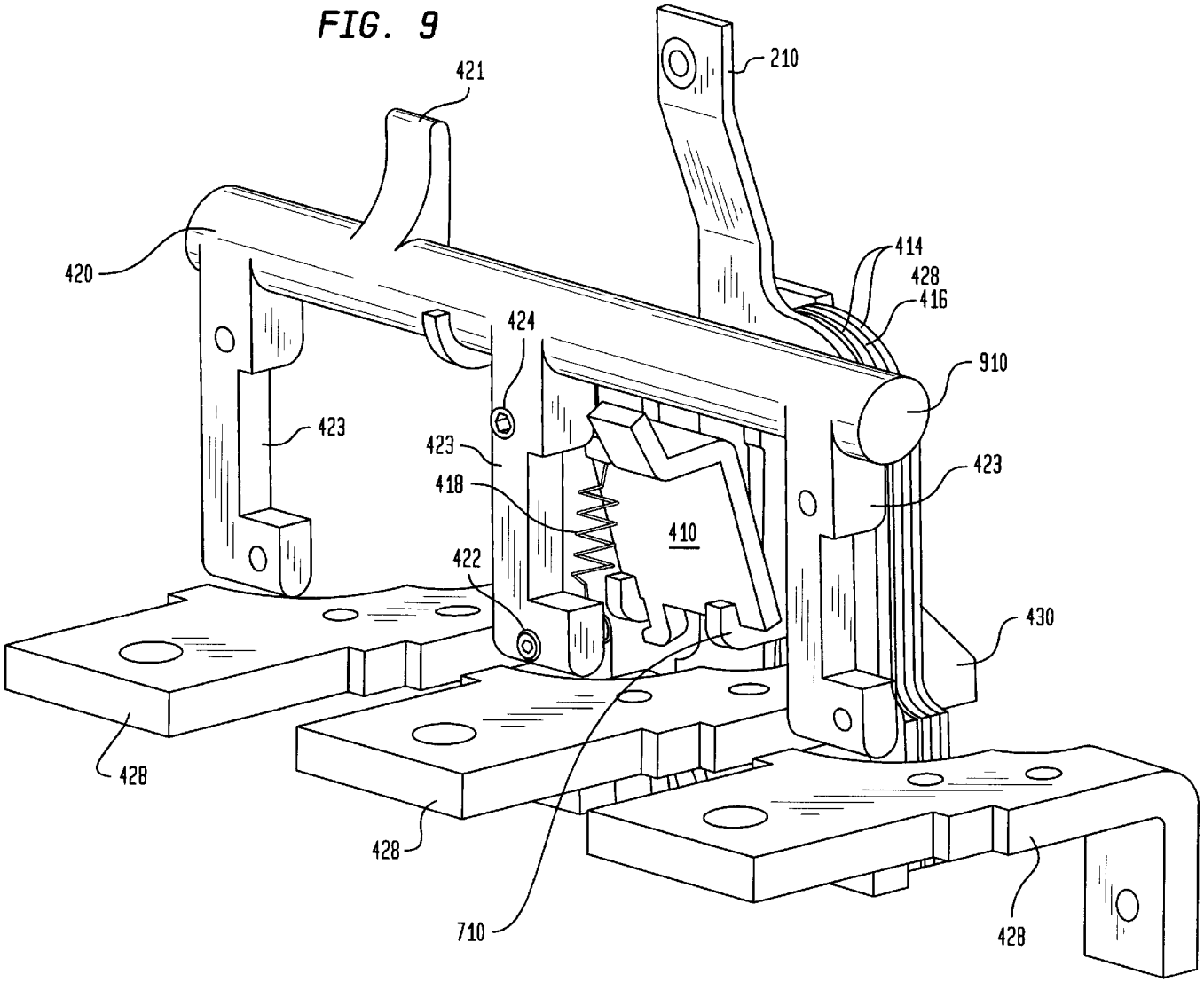
FIGS. 9 and 10 are isometric drawings of selected components of the thermal and magnetic trip unit which are useful for describing the adjustment mechanism.
Figure 10:
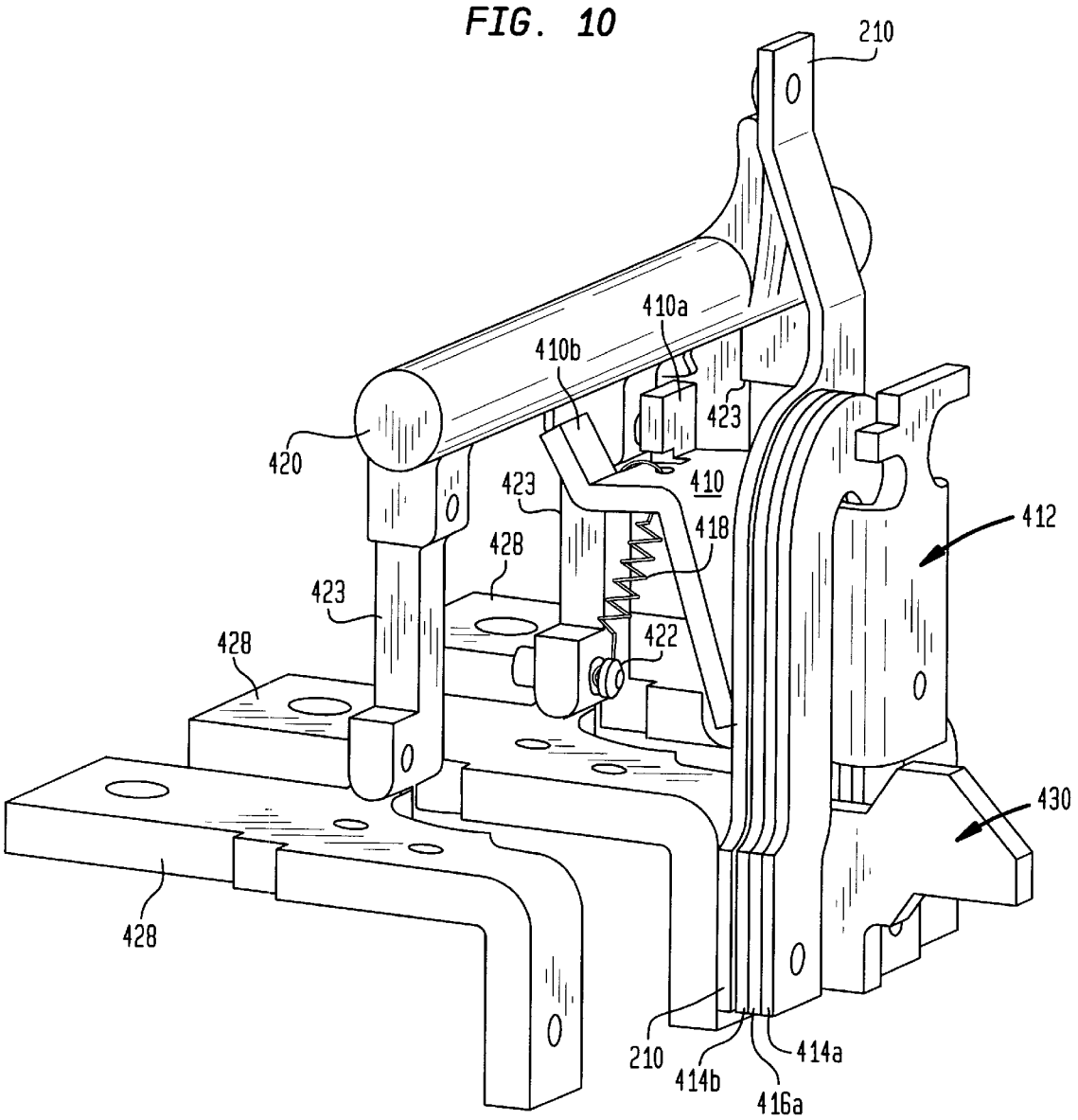

FIGS. 9 and 10 are isometric drawings which show the thermal and magnetic structure for the center pole of the circuit breaker 100 while showing the load contacts 428 for each of the three poles and the common adjustment bar 420. Although not shown in FIGS. 9 and 10, each of the outer poles of the breaker has a thermal and magnetic structure which is identical to that shown for the center pole.

The adjustment bar 420 is shown as a sideways "E", having three legs 423, one for each pole of the breaker. The adjustment bar 420 is coupled to a biasing spring (not shown) and is configured to pivot about an axis 910 in the circuit breaker 100. The biasing spring for the adjustment bar 420 may be, for example, a torsion spring which biases the arm 420 for rotation in a counterclockwise direction about the axis 910. The adjustment bar 420 includes a tab 421 which extends in a generally upward direction from the top surface of the bar 420. The tab 421 engages an adjustment cam 425 (shown in FIGS. 2 and 11). The adjustment cam 425, when turned, rotates the adjustment bar 420 about the axis 910, causing the legs 423 to move closer to or farther away from their respective thermal and magnetic structures. As the adjustment bar 420 is rotated, the top of the armature 410 moves closer to the yoke 412 or farther away from the yoke 412, respectively decreasing or increasing the gap between the armature 410 and yoke 412. In addition, as the bar 420 is rotated, the biasing springs 418 are rotated, changing the angle of the springs 418 with respect to the armatures 410. This change in angle changes the torque that the armature must generate in order to engage the yoke 412. Thus, the adjustment knob 224 and adjustment cam 425 may be used to change both the armature gap and force in order to adjust the trip level of the circuit breaker between minimum and maximum settings.

The three legs 423 of the exemplary adjustment bar 420 are used to calibrate the respective magnetic structures in each of the three poles of the circuit breaker 100. In FIG. 9, the leg 423 for the center pole of the adjustment bar 420 includes 2 calibration screws 422 and 424. Calibration screw 424 when turned, moves the upper portion of the armature 410 closer to or farther away from the yoke 412, effectively adjusting the gap between the armature and the yoke. The calibration screw 422, when turned, adjusts the tension of the biasing spring 418, which is connected to the upper portion of the armature, pulls the armature 410 toward the respective leg 423 of the calibration and adjustment arm 420. As the angle of this spring is increased or decreased by turning the calibration screw 422, the torque—and, thus, the level of current flow—needed to magnetically trip the corresponding pole of the breaker is respectively increased or decreased. Using these two calibrations, each pole of the breaker may be separately calibrated to have a precisely defined gap and spring tension which produces a tripping of the breaker at a desired current level. In addition, the adjustment knob 224 and cam 425 may be used, as described above, to rotate the entire adjustment bar 420 to effect a change in the magnitude of the trip level for all poles of the breaker.

The calibration screws on the legs 423 of the calibration and adjustment bar 420 operate as shown in FIG. 10. When calibration screw 422 is turned, the end of the exemplary spring 418 attached to the adjustment screw is pulled toward the respective leg 423 of the calibration and adjustment bar 420, increasing the angle between the spring and the armature 410. As the angle is increased, the torque needed to rotate the armature 410 toward the trip bar 220 is increased, similarly as the angle is decreased, the torque needed to rotate the armature 410 is decreased. The calibration screw 424 (shown in FIG. 9) pushes directly against a tab 410*a* on the armature 410. As this screw is advanced, the gap between the armature 410 and the yoke 412 decreases; as the screw is retracted, the gap between the armature and yoke increases.

The magnetic structure for all poles of the breaker may be adjusted as follows. When the adjustment bar 420 is rotated in a clockwise direction by the cam 425 (shown in FIG. 11), the separation between the armatures 410 and the yokes 412 increases for all poles of the breaker 100 as does the angle at which the respective springs 418 act against the armatures 410. Conversely, as the adjustment bar 420 is rotated in a counterclockwise direction, the distance between the armature 410 and the yoke 412 decreases and the angle of the spring 418 also decreases. As shown in FIG. 10, the armature 410 includes a second tab, 410*b,* which engages the trip bar. It is this tab which pushes against the lower surface 220*b* of the trip bar 220 when the magnetic structure of at least one pole trips the circuit breaker 100.

Figure 11:
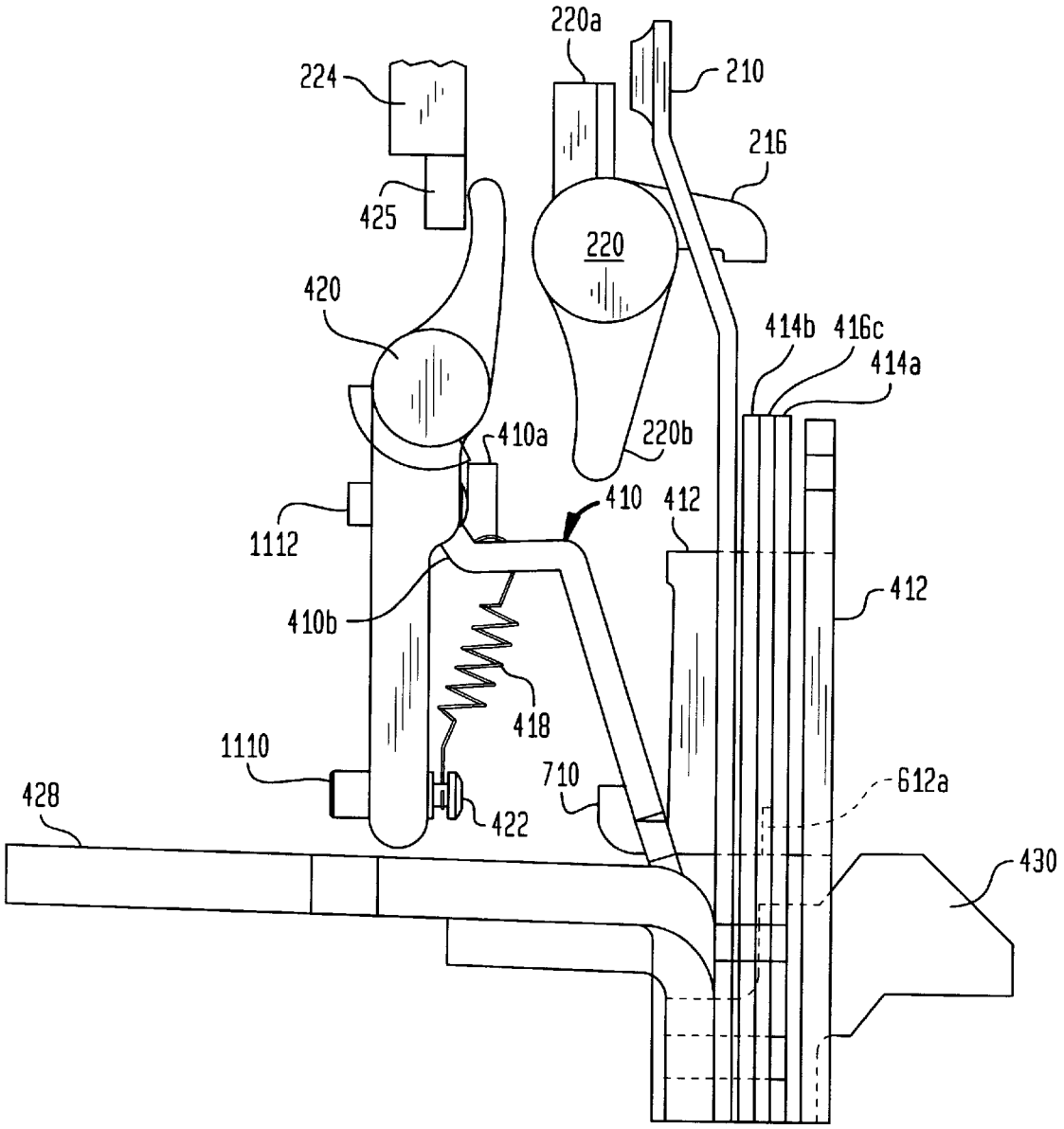
FIG. 11 is a cutaway side plan view of the thermal and magnetic trip unit shown in FIGS. 9 and 10.

FIG. 11 is a cutaway side plan view, taken along lines 4—4, shown in FIG. 1, of the circuit breaker trip unit 114. FIG. 11 shows the thermal and magnetic structure, the adjustment bar 420 and the trip bar 220. During a relatively long duration but low level overcurrent condition, the trip unit would operate as follows. Current flowing from the bus 430 flows through the heating elements 414*a,* and 414*b,* which are connected by the bus element 612*a* and through the bimetallic element 210, causing the bimetallic element to deflect toward the surface 220*a* of the trip bar 220. As the bimetallic element makes contact with the surface 220*a,* the trip bar 220 rotates in a counterclockwise direction, raising the latch 216 causing it to disengage from the latch kicker 212 (shown in FIG. 2). As described above, the amount of current needed to produce the deflection of the bimetallic element 210 which disengages the latch kicker 212 may be adjusted by changing the number of heating elements and the number of insulators.

In a minimum configuration, the largest deflection for the smallest amount of current, is produced having two heating elements 412*a,* and 412*b,* two insulating elements 416*a* and 416*b* and two connecting bus elements 612*a* and 612*b* (as shown in FIG. 6) such that the heating elements are connected in series with the bimetallic element and form a coil having almost three complete turns.

The maximum configuration is produced with no insulating elements 416 and the two (or three) heating elements 414*a* and 414*b,* connecting bus element 612*a,* insulator 416*a* coupled in parallel with the bimetallic element 210. In addition, the deflection of the bimetallic element needed to trip the breaker may be adjusted by adjusting the separation between the surface 220*a* and bimetallic element 210. As described above with reference to FIGS. 2 and 4 this adjustment may be accomplished using the adjustment knob 224 which rotates the cam surface 425 (both shown in FIG. 2). Table 1 shows several different configurations of the thermal unit arranged such that the first entry produces the proper deflection of the bimetallic element 210 for a low rated current and the last entry produces the proper deflection for a high rated current.

TABLE 1

| heating elements 414 | Insulators 416 | series | parallel |
|---|---|---|---|
| 3 | 3 | 3 | 0 |
| 2 | 2 | 2 | 0 |
| 1 | 1 | 1 | 0 |
| 0 | 0 | 0 | 0 |
| 1 | 0 | 0 | 1 |
| 2 | 1 | 1 | 1 |
| 3 | 2 | 2 | 1 |
| 2 | 0 | 0 | 2 |
| 3 | 1 | 1 | 2 |
| 3 | 0 | 0 | 3 |

In Table 1, the columns "series" and "parallel" describe, respectively, the number of heating elements 414 which are configured in series with the bimetallic element 210 (using an insulator 416 and a connecting bus element 612, as shown in FIG. 6) and the number of heating elements 414 which are connected in parallel with the bimetallic element 210 without interstitial insulators 416.

For relatively large current flows (i.e. larger multiples of the rated current), the magnetic structure of the thermal and magnetic trip unit operates to trip the breaker. This structure operates as follows. As current flows from the bus 430 through the thermal structure formed by the heating elements 414*a,* and 414*b,* connecting bus element 612*a,* insulator 416*a* and bimetallic element 210, it generates a magnetic field which is concentrated by the yoke 412 (or yokes 412*a* and 412*b*). This magnetic field increases with an increase in the level of current flowing through the breaker and, when a threshold current level is reached, generates a magnetic force which causes at least one of the armatures 410 to move toward the respective yoke 412. As the armature 410 is attracted toward the yoke 412, the tab 410*b* on the armature 410 engages a protrusion 220*b* on the bottom of the trip bar 220. As the armature 410 engages the protrusion 220*b,* the trip bar 220 rotates in a counterclockwise direction raising the latch 216 to release the latch kicker 212.

The operation of the magnetic portion of the thermal and magnetic trip unit may be adjusted by changing the number of insulators and heating elements used in the thermal structure to increase the number of turns for the current flowing through the thermal structure and thus the magnetic field generated by that current. In addition, the magnetic field generated for a given current level may be increased by including two yoke units 412*a* and 412*b* instead of a single yoke unit. For a given structure, the amount of magnetic force needed to attract the armature 410 to the yoke 412 may be increased or decreased by increasing or decreasing the gap between the armature 410 and yoke 412 and by increasing or decreasing the angle at which the biasing spring 418 acts against the armature 410. These adjustments may be made for each pole individually by adjusting the calibration screws 422 and 424 on the respective leg 423 of the adjustment bar 420 or they may be made for all poles by rotating the adjusting bar420 using the adjustment cam 425. Table 2 shows various configurations of the heating elements 414, bimetallic element 210 and yokes 412 which produce decreasing sensitivities in the magnetic trip unit.

TABLE 2

| thermal unit turns | yokes 412 |
|---|---|
| 4 | 2 |
| 3 | 2 |
| 2 | 2 |
| 1 | 2 |
| 4 | 1 |
| 3 | 1 |
| 2 | 1 |
| 1 | 1 |

In table 2, one turn is formed by the bimetallic element 210 or by a combination of a heating element 414, connecting bus element 612 and insulator 416, as shown in FIG. 6. The thermal unit has only one turn if no heating elements 414 exist or if all of the heating elements 414 are connected in parallel with the bimetallic element 210 (i.e. without interstitial insulators). While the invention has been described in terms of an exemplary embodiment, it is contemplated that it may be practiced as outlined in the above within the scope of the appended claims. For example, while tables 1 and 2 show a maximum of three heating elements 414 and three insulators 416, it is contemplated that a larger number may be used within the scope of the present invention.

What is claimed:

1. A trip unit for a circuit breaker, the circuit breaker including a principal conductive current path through which a load current flows, the circuit breaker further including first and second contacts which are closed to allow the load current to flow through the principal conductive current path and which are opened to stop current flow through the principal conductive current path, wherein the breaker includes a trip bar that is engaged to open the contacts of the circuit breaker on the occurrence of a trip condition, the trip unit comprising:

a bimetallic element configured adjacent to the trip bar and having a conductive path which is coupled to conduct at least a portion of the load current when the contacts of the circuit breaker are closed, the conductive path of the bimetallic element having an ohmic resistance such that, during an overcurrent condition, the current conducted by the conductive path generates heat within the bimetallic element and the bimetallic element is responsive to heat to bend and engage the trip bar;

a generally "U" shaped conductive heating element having first and second legs which define a resistive current path, wherein the load current flows through the heating element from the first leg to the second leg, and the second leg of the heating element is electrically coupled at a connecting point to provide the load current to the bimetallic element;

a configurable insulator adapted to be inserted between the heating element and the bimetallic element to selectively electrically insulate the heating element from the bimetallic element except for the connecting point, whereby when the insulator is inserted, the resistive current path of the heating element is in series with the conductive path of the bimetallic element and, when the insulator is removed, the resistive current path of the heating element is in parallel with the conductive path of the bimetallic element.

2. A trip unit according to claim 1, wherein the bimetallic element includes a generally "U" shaped portion having first and second legs configured in parallel with the first and second legs of the heating element, and the connecting point between the heating element and the bimetallic element includes a connecting bus element which, when the insulator is inserted, connects the second leg of the heating element to the first leg of the bimetallic element to form a coil, such that the current conducted by the "U" shaped conductive heating element and the current conducted by the "U" shaped portion of the bimetallic element flow in series.

3. A trip unit according to claim 2, further comprising:

a magnetically permeable yoke having a generally "U" shaped cross section which surrounds one leg of the bimetallic element and the heating element on three sides such that the yoke concentrates a magnetic field generated by the load current flowing through the combined bimetallic element and heating elements wherein when the configurable insulator is inserted between the heating element and the bimetallic element, a greater magnetic field is generated than when the configurable insulator is not inserted between the heating element and the bimetallic element;

a ferromagnetic armature, separated from the yoke by a gap such that the magnetic field concentrated by the yoke produces a magnetic force which causes the armature to engage the yoke when the magnetic force is greater than a predetermined threshold force, the armature being positioned, with respect to the trip bar such that, when the armature engages the yoke, the armature also engages the trip bar.

4. A trip unit according to claim 3, further comprising a removable further magnetically permeable yoke, configured to surround the other leg of the combined heating element and bimetallic element, the further yoke, when inserted, acting to increase the magnetic force attracting the armature to the yoke relative to the magnetic force attracting the armature when the further yoke is absent.

5. A trip unit according to claim 1, further comprising:

a further configurable generally "U" shaped conductive heating element, having first and second legs which are adapted to be configured in parallel with respective first and second legs of the heating element and being electrically connected to the heating element at a further connecting point;

a further configurable insulator adapted to be inserted between the heating element and the further heating element, the further insulator, when inserted, acting to insulate the heating element from the further heating element except for the further connecting point, whereby when the further insulator is inserted, the further heating element defines a resistive current path which is in series with the resistive current path of the heating element and, when the further insulator is removed, the heating element and the further heating element are electrically connected in parallel.

6. A trip unit according to claim 5, further including a configurable further connecting bus element which, when the further insulator is inserted, connects the first leg of the heating element to the second leg of the further heating element to define the further connecting point, such that the combination of the bimetallic element, connecting bus element, heating element, further connecting bus and further heating element forms a coil having two turns.

7. A trip unit according to claim 3, further comprising a magnetic calibration and adjustment bar for the predetermined threshold force needed to cause the armature to engage the yoke, the magnetic adjustment bar including:

a spring, having a first end coupled to the armature and a second end coupled to the magnetic calibration and adjustment bar, the spring exerting a force on the armature which is overcome by the magnetic force concentrated in the yoke;

a first calibrating element, coupled to the spring to selectively increase or decrease the force exerted by the spring on the armature;

a second calibrating element, coupled to the armature for selectively increasing or decreasing the gap between the armature and the yoke.

8. A trip unit according to claim 7, wherein the magnetic calibration and adjustment bar includes a leg which contains the first and second calibrating elements, the leg having first and second ends being configured to pivot about an axis extending through the first end, the magnetic calibration and adjustment bar further including an adjusting element which causes the leg to pivot, thereby concurrently adjusting the force exerted by the spring on the armature and the gap between the armature and the yoke.

9. A thermal and magnetic trip unit for a circuit breaker, the circuit breaker including a principal conductive current path through which load current flows, the circuit breaker further including first and second contacts which are closed to allow the load current to flow through the principal conductive current path and which are opened to stop current flow through the principal conductive current path, wherein the breaker includes a trip bar that is engaged to open the contacts of the circuit breaker on the occurrence of a trip condition, the trip unit comprising:

a bimetallic element configured adjacent to the trip bar and having a conductive path which is coupled to conduct at least a portion of the load current when the contacts of the circuit breaker are closed, the conductive path of the bimetallic element having an ohmic resistance such that, during an overcurrent condition, the current conducted by the conductive path generates heat within the bimetallic element and the bimetallic element is responsive to heat to bend and engage the trip bar;

a generally "U" shaped conductive heating element having first and second legs which define a resistive current path, wherein the load current flows through the heating element from the first leg to the second leg;

a configurable insulator adapted to be inserted between the heating element and the bimetallic element to insulate the heating element from the bimetallic element a configurable connecting bus element which is adapted to electrically connect the second leg of the heating element to the bimetallic element, whereby when the insulator and the connecting bus element are inserted, the resistive current path of the heating element is in series with the conductive path of the bimetallic element and the combination of the heating element, the connecting bus element and the bimetallic element form a coil, and whereby, when the insulator is removed, the resistive current path of the heating element is in parallel with the conductive path of the bimetallic element.

10. A trip unit according to claim 9, further comprising:

a magnetically permeable yoke having a generally "U" shaped cross section which surrounds one leg of the combined heating element and bimetallic element on three sides such that the yoke concentrates a magnetic field generated by the combined heating element and bimetallic element, wherein when the configurable insulator and configurable connecting bus element are inserted between the heating element and the bimetallic element, a greater magnetic field is generated than when the configurable insulator and configurable bus element are not inserted between the heating element and the bimetallic element;

a ferromagnetic armature, separated from the yoke by a gap such that the magnetic field concentrated by the yoke produces a magnetic force which causes the armature to engage the yoke when the magnetic force is greater than a predetermined threshold force, the armature being positioned, with respect to the trip bar such that, when the armature engages the yoke, the armature also engages the trip bar.

11. A trip unit according to claim 10, further comprising a configurable further magnetically permeable yoke, adapted to surround the other leg of the combined heating element and bimetallic element, the further yoke, when inserted, acting to increase the magnetic force attracting the armature to the yoke relative to the magnetic force attracting the armature when the further yoke is absent.

12. A thermal and magnetic trip unit for a circuit breaker, the circuit breaker including a principal conductive current path through which load current flows, the circuit breaker further including first and second contacts which are closed to allow the load current to flow through the principal conductive current path and which are opened to stop current flow through the principal conductive current path, wherein the breaker includes a trip bar that is engaged to open the contacts of the circuit breaker on the occurrence of a trip condition, the trip unit comprising:

a bimetallic element configured adjacent to the trip bar and having a conductive path which is coupled to conduct at least a portion of the load current when the contacts of the circuit breaker are closed, the conductive path of the bimetallic element having an ohmic resistance such that, during an overcurrent condition, the current conducted by the conductive path generates heat within the bimetallic element and the bimetallic element is responsive to heat to bend and engage the trip bar;

a generally "U" shaped first conductive heating element having first and second legs which define a resistive current path, wherein the load current flows through the first heating element from the first leg to the second leg;

a configurable first insulator adapted to be inserted between the heating element and the bimetallic element to insulate the heating element from the bimetallic element a configurable first connecting bus element which is adapted to electrically connect the second leg of the heating element to the bimetallic element, a generally "U" shaped configurable second conductive heating element having first and second legs which define a resistive current path, wherein the load current flows through the second heating element from the first leg to the second leg;

a configurable second insulator adapted to be inserted between the second heating element and the first heating element to electrically insulate the second heating element from the first heating element a configurable second connecting bus element which is adapted to electrically connect the second leg of the second heating element to the first heating element, whereby when the second insulator and the second connecting bus element are inserted, the resistive current path of the second heating element is in series with the conductive path of the first heating element and the conductive path of the bimetallic element and the combination of the first and second heating elements, the first and second connecting bus elements and the bimetallic element form a coil, and whereby, when the first and second insulators are removed, the resistive current paths of the first and second heating elements are in parallel with the conductive path of the bimetallic element;

a magnetically permeable yoke having a generally "U" shaped cross section which surrounds one leg of the combined first and second heating elements and bimetallic element on three sides such that the yoke concentrates a magnetic field generated by the combined first and second heating elements and the bimetallic element;

a ferromagnetic armature, separated from the yoke by a gap such that the magnetic field concentrated by the yoke produces a magnetic force which causes the armature to engage the yoke when the magnetic force is greater than a predetermined threshold force, the armature being positioned, with respect to the trip bar such that, when the armature engages the yoke, the armature also engages the trip bar.

13. A trip unit according to claim 12, further comprising a configurable further magnetically permeable yoke, adapted to surround the other leg of the combined first and second heating elements and bimetallic element, the further yoke, when inserted, acting to increase the magnetic force attracting the armature to the yoke relative to the magnetic force attracting the armature when the further yoke is absent.

* * * * *